US006285535B1

(12) United States Patent
Nakamura

(10) Patent No.: US 6,285,535 B1
(45) Date of Patent: Sep. 4, 2001

(54) SURGE ABSORBER

(75) Inventor: Masahiko Nakamura, Saitama (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/403,594

(22) PCT Filed: Feb. 23, 1998

(86) PCT No.: PCT/JP98/00719

§ 371 Date: Mar. 10, 2000

§ 102(e) Date: Mar. 10, 2000

(87) PCT Pub. No.: WO99/43061

PCT Pub. Date: Aug. 26, 1999

(51) Int. Cl.[7] ..... H01T 4/10; H01T 4/12

(52) U.S. Cl. ..... 361/56; 361/91.1; 361/111; 361/118

(58) Field of Search ..... 174/140 R; 313/581, 313/631, 595, 235, 355; 361/56, 104, 111, 117, 118, 120, 220, 212, 129, 137, 91.1

(56) References Cited

U.S. PATENT DOCUMENTS 3,900,767 * 8/1975 Person ..... 317/61.5
5,404,126 * 4/1995 Kasai et al. ..... 361/103
5,969,924 * 10/1999 Noble ..... 361/56

FOREIGN PATENT DOCUMENTS 54-114026 U * 8/1979 (JP) .
4-56185 * 2/1992 (JP) .
5-33493 U * 4/1993 (JP) .
6-68949 * 3/1994 (JP) .
4-277279 * 10/1998 (JP) .

* cited by examiner

*Primary Examiner*—Josie Ballato
*Assistant Examiner*—Vaughn Marquis
(74) *Attorney, Agent, or Firm*—Oblon, Spivak, McClelland, Maier & Neustadt, P.C.

(57) ABSTRACT

An inductive lightening surge installed at input and output circuits or other locations of circuits of communication devices where a surge noise may be generated or a surge absorber for avoiding failure and erroneous operation of electronic devices by mixed contact or the like of AC circuits in which a first terminal electrode 2, a conductive film 5 having a micro-gap 3 and a second terminal electrode 4 are formed in shapes of concentric circles on an insulating substrate 1 in a flat plate shape.

20 Claims, 8 Drawing Sheets

SURGE ABSORBER

BACKGROUND OF THE INVENTION

1. Field of the Invention

The present invention relates to a surge absorber for absorbing surge noise applied on electronic devices.

2. Discussion of the Background

Japanese Examined Patent Publication No. JP-B-63-57918 discloses a surge absorber having a structure in which a conductive ceramic thin film is formed on the surface of an insulating member having a cylindrical shape, a micro-gap is formed to divide the conductive ceramic thin film in the circumferential direction and a total thereof is hermetically sealed in a cylindrical glass in a state where gas is filled at inside thereof. Further, Japanese Unexamined Utility Model Publication No. JU-A-49-80351 proposes a surge absorber in which electrodes each in a shape of a pinnacle having points sharpened toward micro-gaps are formed on an insulating substrate in a flat plate shape.

FIG. 17 and FIG. 18 show sectional views of conventional surge absorbers.

FIG. 17 shows a surge absorber in a cylindrical shape. Explaining the principle of operating the surge absorber, when surge is applied on a cylindrical surge absorber 40, arc discharge is caused in a micro-gap 41 and an enclosed gas is successively ionized by the discharge to cause corona discharge by which surge is absorbed.

FIG. 18 shows a surge absorber 42 in a flat plate shape and the principle of operation is basically the same as that of the cylindrical surge absorber.

However, according to the cylindrical one of the conventional surge absorbers, lead wires are extended from central portions of the both ends of the cylinder and therefore, there poses a problem where surface mounting or automatic mounting thereof is difficult. Further, the outer shape is cylindrical and therefore, air-tight cover material other than glass is difficult to use.

Further, according to the one in a flat plate shape, front ends in the micro-gaps are sharpened and accordingly, there poses a problem where the front ends are liable to chip off by discharge when surge is applied with the result of a short life.

SUMMARY OF THE INVENTION

In view of the situation described above, it is an object of the present invention to provide a surge absorber which is easy in surface mounting and is provided with high reliability in respect of repeated discharge.

A first aspect of the present invention is characterized in comprising:

(1) an insulating substrate in a flat plate shape;

(2) a conductive film having a gap in an annular shape and formed in a circular disk shape concentric with the gap on the insulating substrate;

(3) a first electrode arranged at a central portion of the conductive film;

(4) a second electrode in an annular shape concentric with the gap arranged at a peripheral edge portion of the conductive film;

(5) an air-tight crowned member for hermetically sealing the conductive film, the first electrode and the second electrode in a state where a predetermined gas is filled at an inside thereof in cooperation with the insulating substrate;

(6) a first terminal arranged at an outside of the air-tight crowned member for being electrically connected to the first electrode; and (7) a second terminal arranged at the outside of the air-tight crowned member for being electrically connected to the second electrode.

Here, according to the surge absorber of the present invention, the first electrode and the first terminal may be electrically connected by a through hole formed at a portion of the insulating substrate where the first electrode is arranged, the through hole being penetrated between a surface and a rear face of the insulating substrate and filled with a conductor electrically connected to the first electrode at an inside thereof, and a conductive film formed on the rear face of the insulating substrate for electrically connecting the conductor in the through hole with the first terminal, or the first electrode and the first terminal may be electrically connected by a via hole formed at a portion of the insulating substrate where the first electrode is arranged, the via hole being filled with a conductor electrically connected to the first electrode at an inside thereof, and a conductive layer formed at an inside of the insulating substrate, electrically connected to the first terminal and electrically connected to the conductor at the inside of the via hole at a bottom portion of the via hole, or the surge absorber of the present invention may comprises an insulating film formed on the insulating substrate: the conductive film, the first electrode and the second electrode are formed or arranged on the insulating film; and the first electrode and the first terminal may electrically be connected by a via hole formed at a position of the insulating film where the first electrode is arranged, the via hole being filled with a conductor electrically connected to the first electrode at an inside thereof, and a conductive film formed between the insulating substrate and the insulating film for electrically connecting the conductor at the inside of the via hole with the first terminal.

According to the surge absorber of the present invention, all of the first electrode, the second electrode, the conductive film and the micro-gap are arranged on the same plane above the insulating substrate in a flat plate shape and therefore, the outer configuration can be constituted on the flat plate where surface mounting thereof is facilitated.

Further, since the outer configuration can be a flat plate shape, ceramics material of alumina or the like can be used as the material for the air-tight crowned member.

Further, according to the surge absorber of the present invention, all of the first electrode, the second electrode, the conductive film and the micro-gap are formed on the same plane and in shapes of concentric circles and accordingly, discharge is uniformly caused at a total region of the micro-gap and even when a portion of the conductive film is chipped off by discharge, the discharge start voltage is not variable and reliability in respect of repeated discharge is high.

Further, according to the surge absorber of the present invention, as means for connecting the first electrode arranged at the central portion and the first terminal which serves to connect to outside, for example, the through hole installed at the insulating substrate and the conductive film on the rear face of the substrate, or the via hole installed at the insulating substrate and the conductive layer formed at the inside of the substrate or the via hole installed at the insulating film and the conductive layer below the insulating film can be adopted by which a surge absorber having a structure comprising a small number of parts and yet having high reliability can be realized.

Incidentally, the basic principle of the surge absorber according to the present invention is the same as that disclosed in Japanese Examined Patent Publication No. JP-A-63-57918 mentioned above and therefore, excellent surge absorbing characteristic and high reliability provided to the surge absorber disclosed in the publication are followed as they are.

According to a second aspect of the present invention, there is provided the surge absorber according to the first aspect, wherein the second electrode constitutes the air-tight crowned member.

In this case, the second electrode can be a portion of the air-tight crowned member or can be a total thereof.

By constituting the surge absorber in this way, it can be downsized and an area for mounting thereof to an electric circuit or the like can be reduced compared with the case of the first embodiment.

Further, according to a third aspect of the present invention, there is provided a surge absorber in the first or the second aspect of the present invention, wherein the first terminals are formed respectively at two side faces of the insulating substrate remote from each other and the second terminals are formed respectively on two other side faces of the insulating substrate.

By constituting the surge absorber in this way, as explained later in reference to the drawings, the surge absorber can be arranged to ride over a signal line or a grounding line or on the signal line or the grounding line by which the density of wiring on a circuit board can be increased.

According to a fourth aspect of the present invention, there is provided a surge absorber in any of the first through the third aspects, further comprising a third terminal arranged at an outside of the air-tight crowned member constituted by being connected to either one terminal of the first terminal and the second terminal via an electrically connecting path in a film-like shape formed on a rear face of the insulating substrate with at least one portion of the path being a fuse in a film-like shape.

According to a conventional surge absorber, regardless of types, a fuse may be used in combination with the surge absorber for preventing overvoltage or overcurrent. The reason is to prevent burning of circuits caused by overheat of the surge absorber per se when surge current continues for a long period of time. In this case, the fuse must be attached separately from the surge absorber and therefore, there pose problems of an increase in mounting area, an increase in mounting cost and so on. Although means for resolving the problems has conventionally been disclosed (for example, Japanese Unexamined Patent Publication No. JP-A-3-230485), owing to a structure thereof where the fuse is separately integrated, the fabrication steps are complicated and the cost is increased as a result.

However, according to the surge absorber of the aspect of the present invention, the fuse is formed on a rear side face opposite to a insulating substrate face where the conductive film is formed and accordingly, the formation is facilitated and the product per se is prevented from becoming large-sized. Further, the fuse is not cut by mechanical vibration and the reliability is high.

According to a fifth aspect of the present invention, there is provided a surge absorber in any one of the first through the fourth embodiments, further comprising a condenser comprising a plurality of sheets of conductive films at least one sheet of which extends at the inside of the insulating substrate and which extend in parallel with each other, the condenser being formed between the first terminal and the second terminal.

According to a conventional surge absorber, a high frequency noise having a low voltage and high frequency cannot be removed and the surge absorber is used in combination with a condenser when the high frequency noise needs to be removed. However, when a plurality of members are used, the problems of an increase in mounting area and an increase in mounting cost cannot be avoided. Further, although there have been proposed surge absorbers each incorporating a condenser (Japanese Unexamined Patent Publication No. JP-A-8-83670, Japanese Unexamined Patent Publication No. JP-A-8-102355) in order to resolve the problems, according to each of these surge absorbers, the structure is complicated and the cost is high.

By contrast, according to the surge absorber having the fifth aspect of the present invention, the condenser is built in and therefore, the high frequency noise having the low voltage and high frequency can also be removed. Conductive films for constituting the condenser for removing the high frequency noise are formed at inside of an insulating substrate and therefore, there causes no problem such as large-sizing of an element, an increase in an area of surface mounting or the like caused by attaching a condenser for removing the high frequency noise to a surge absorber. Further, the condenser for removing the high frequency noise can be formed by using a conventional method of fabricating a multiple-layer substrate and low cost for forming the condenser can be achieved.

DETAILED DESCRIPTION OF THE PREFERRED EMBODIMENTS

Although an explanation will be given of embodiments of the present invention as follows, the present invention is not limited to the embodiments.

FIG. 1 through FIG. 5 show the embodiments of the first aspect of surge absorbers according to the present invention.

Figure 1:
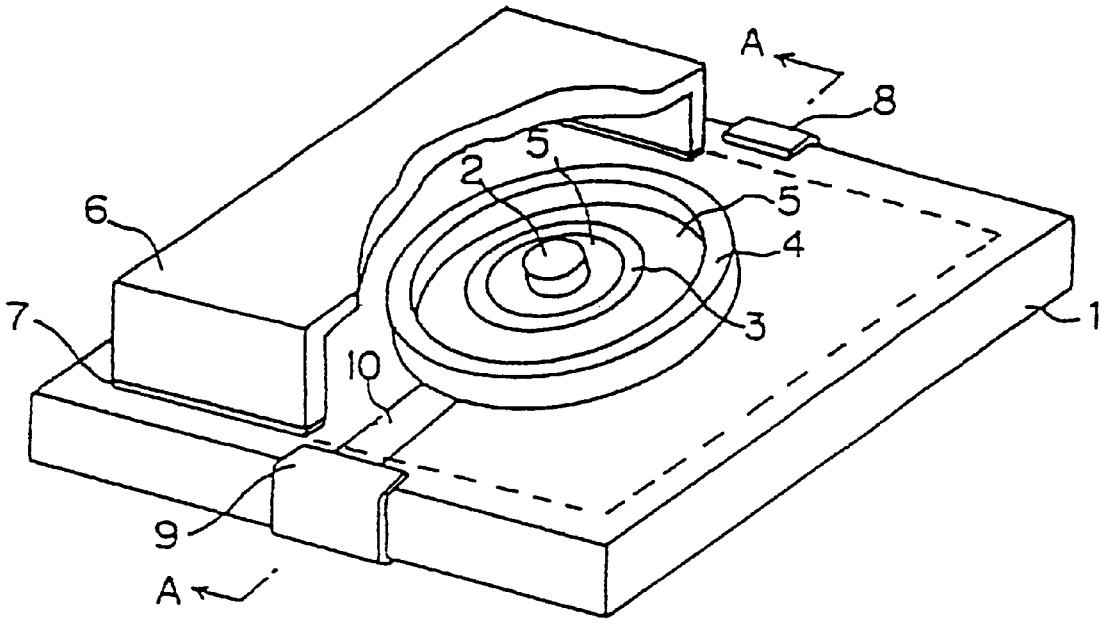
FIG. 1 is a perspective view showing the first aspect of a surge absorber according to the present invention and showing the inner structure by partially cutting a cap.
Figure 2:
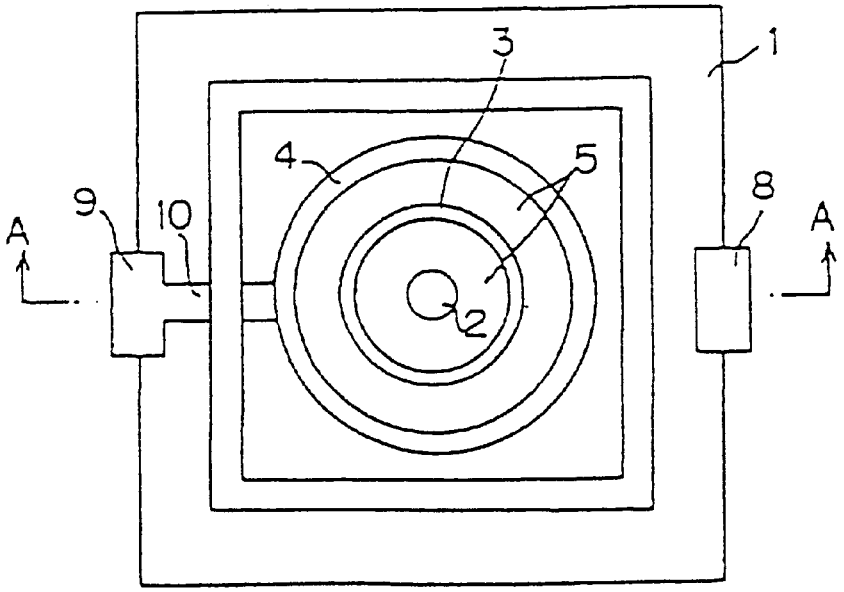
FIG. 2 is a plane view showing the first aspect of the surge absorber according to the present invention perspectively through the cap.
Figure 3:
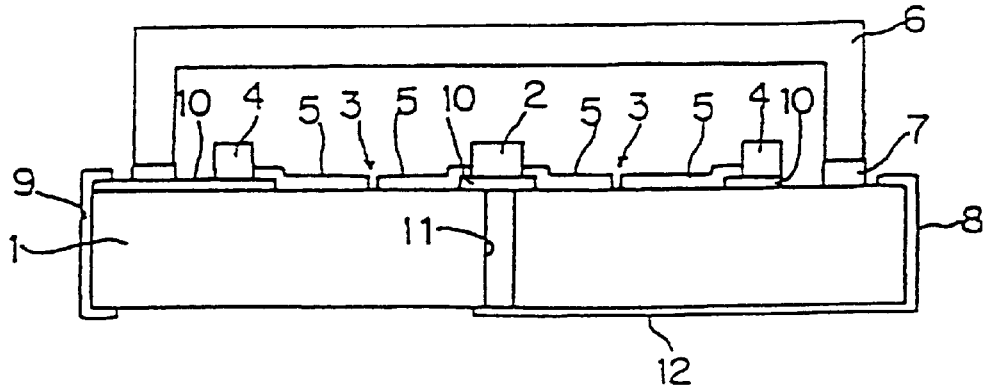
FIG. 3 is a sectional view taken along lines A—A of FIG. 1 and FIG. 2 showing an embodiment of the first aspect of the surge absorber according to the present invention.
Figure 4:
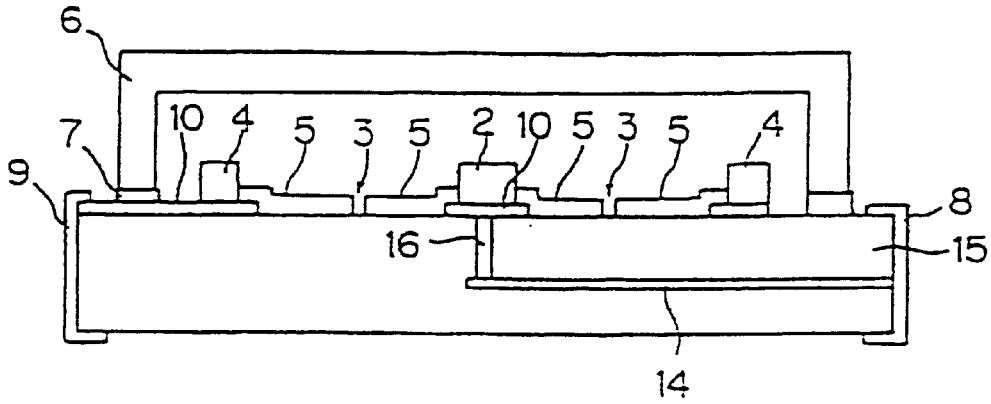
FIG. 4 is a sectional view taken along lines A—A of FIG. 1 and FIG. 2 showing another embodiment of the first aspect of the surge absorber according to the present invention.
Figure 5:
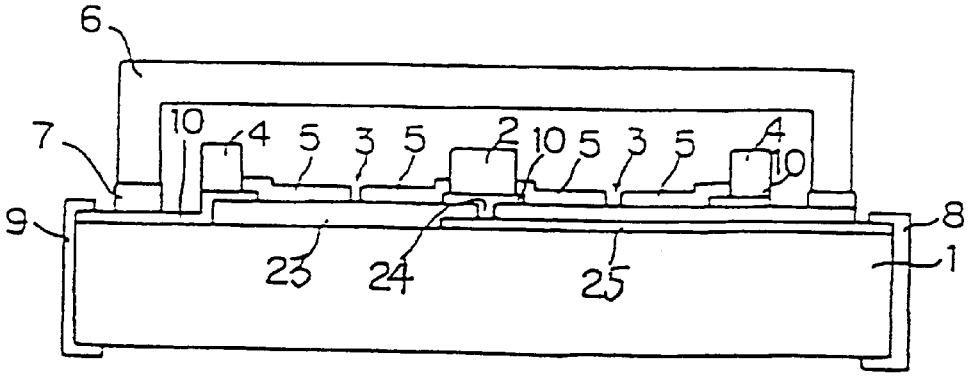
FIG. 5 is a sectional view taken along lines A—A of FIG. 1 and FIG. 2 showing still another embodiment of the first aspect of the surge absorber according to the present invention.

FIG. 1 is a perspective view showing the inner structure by partially cutting a cap, FIG. 2 is a plane view perspectively through the cap and FIG. 3 through FIG. 5 are sectional views taken along lines A—A of FIG. 1 and FIG. 2.

A through hole 11 (refer to FIG. 3) is formed in an alumina substrate 1 in a flat plate shape as an insulating substrate by publicly-known conventional technology, a conductor is filled in the through hole 11, a conductive film 10 is formed on the surface of the alumina substrate 1, a conductive film 12 is formed on the rear face, a first terminal 8 and a second terminal 9 are formed on side faces of the alumina substrate 1, TiN is adhered onto the surface of the alumina substrate as a conductive film 5 by sputtering, successively, a micro-gap 3 in a circular shape having a width of about 50 $\mu$m is formed and the conductive film 5 is formed into a desired circular shape by photoetching, and a first electrode 2 and a second electrode 4 are attached to be brought into contact with the conductive film 5 concentrically with the micro-gap 3. Further, a cap 6 made of alumina ceramics is welded by frit glass 7 by which the micro-gap 3, the first electrode 2 and the second electrode 4 are sealed in Ar gas. Thereby, there is available a surge absorber, the outer shape of which is in a flat plate shape, which is suitable for surface mounting and which is provided with high reliability in respect of repeated discharge.

FIG. 4 is a sectional view showing another embodiment of the first aspect of the surge absorber according to the present invention.

According to this embodiment, as an insulating substrate, a sintered multiple layer substrate 15 in which a conductive layer 14 and a via hole 16 filled with a conductor are formed, is used, the conductive film 10 is formed on the surface of the substrate 15, the terminals 8 and 9 are formed on side f aces of the substrate, a TiN film is adhered onto the surface of the substrate 15 as the conductive film 5 by sputtering, successively, the circular micro-gap 3 having the width of about 50 $\mu$m is formed and the conductive film 5 is formed in a desired circular shape by photoetching and the first electrode 2 and the second electrode 4 are attached to the conductive film 5 concentrically with the micro-gap 3. The cap 6 made of alumina ceramics is welded by the frit glass 7 by which the micro-gap is sealed in Ar gas.

Also according to the embodiment, similar to the first embodiment mentioned above, there is available a surge absorber, the outer shape of which is in a flat plate shape, which is excellent in suitability of surface mounting and which is provided with high reliability in respect of repeated discharge.

FIG. 5 is a sectional view showing still another embodiment of the first aspect of the surge absorber according to the present invention.

According to the embodiment, a substrate of a multiple layer structure having an insulating layer 23, a via hole 24 and an inner conductive film 25 formed on the alumina substrate 1 which is an insulating substrate by a thick-film multilayer process, is used, the conductive film 10 is formed on surfaces of the insulating substrate and the insulating layer, the terminals 8 and 9 are formed on the side faces of the substrate 1, TiN is adhered onto the surface of the insulating layer as a conductive film 5 by sputtering, successively, a circular micro-gap 3 having the width of about 50 $\mu$m is formed and the conductive film 5 is formed in a desired circular shape by photoetching and the first electrode 2 and the second electrode 4 are attached to the conductive film 5 concentrically with the micro-gap 3. A cap 6 made of alumina ceramics is welded by frit glass 7 by which the micro-gap 3 is sealed in Ar gas.

Also according to this embodiment, similar to the two embodiments mentioned above, there is available a surge absorber which is provided with excellent suitability of surface mounting and high reliability.

Figure 6:
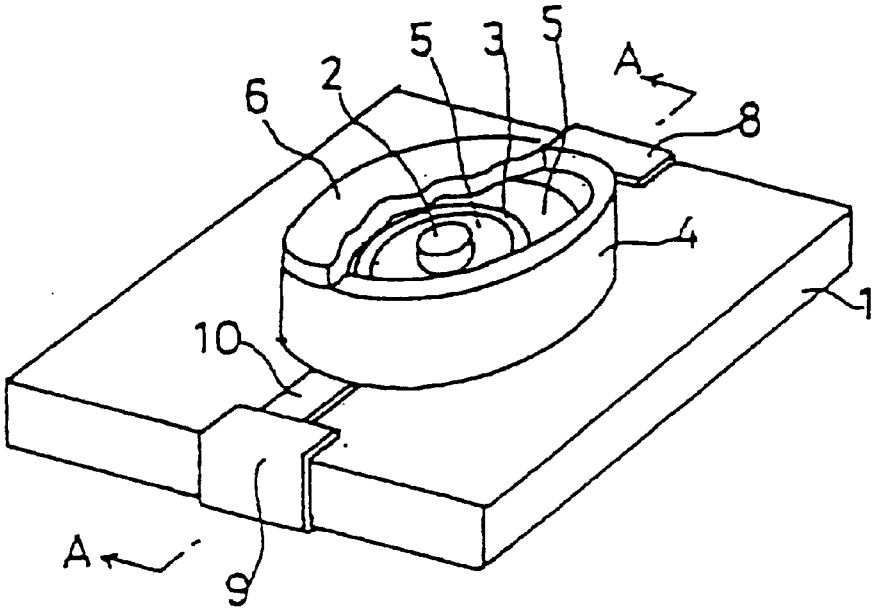
FIG. 6 is a perspective view showing the second aspect of a surge absorber according to the present invention and showing the inner structure by cutting a cap.

FIG. 6 shows the second aspect of a surge absorber according to the present invention. The drawing is a perspective view showing the inner structure by partially cutting a cap.

The through hole 11 (refer to FIG. 3) is formed in the alumina substrate 1 in a flat plate shape which is an insulating substrate by a publicly-known conventional technology, a conductor is filled in the through hole 11, the conductive film 10 is formed on the surface of the alumina substrate 1, the conductive film 12 (similar to FIG. 3) is formed on the rear face, the first terminal 8 and the second terminal 9 are formed on the side faces of the alumina substrate 1, TiN is adhered onto the surface of the alumina substrate as the conductive film 5 by sputtering, successively, the micro-gap 3 in a circular shape having the width of about 50 $\mu$m is formed and the conductive film 5 is formed into a desired circular shape by photoetching and the first electrode 2 and the second electrode 4 are attached to be brought into contact with the conductive film 5 concentrically with the micro-gap 3. The second electrode 4 is a member in an annular shape having a height the same as a height of the first electrode 2 or higher than the first electrode 2. Further, by welding the cap 6 in a circular disk shape made of alumina ceramics on the upper face of the second electrode by the frit glass 7, the micro-gap 3 and the first electrode 2 are sealed in Ar gas in cooperation with the alumina substrate 1 and the second electrode 4. The first electrode 2 and the first terminal 8 are connected to each other by the conductor filled in the through hole 11 installed in the alumina substrate 1 and the conductive film 12 on the rear face of the alumina substrate. Further, the second electrode 4 and the second terminal 9 are connected to each other by the conductive film 10 on the surface of the alumina substrate 1. Thereby, there is available a surge absorber, the outlook of which is formed in a flat plate shape, which is suitable for surface mounting and which is provided with high reliability in respect of repeated discharge.

Further, according to this embodiment, an air-tight crowned member referred to in the present invention is formed by the second electrode 4 and the cap 6 in a circular disk shape, the outer diameter of the air-tight crowned member is the same as the diameter of the second electrode 4 and further downsizing is available compared with the case where an air-tight crowned member is constituted separately from the second electrode 4 such that the second electrode 4 is hermetically sealed at inside thereof.

Further, according to this embodiment, an air-tight crowned member can be constituted only by the second electrode 4. That is, a cap made of metal is used as the second electrode and is brazed to the insulating substrate.

Figure 7:
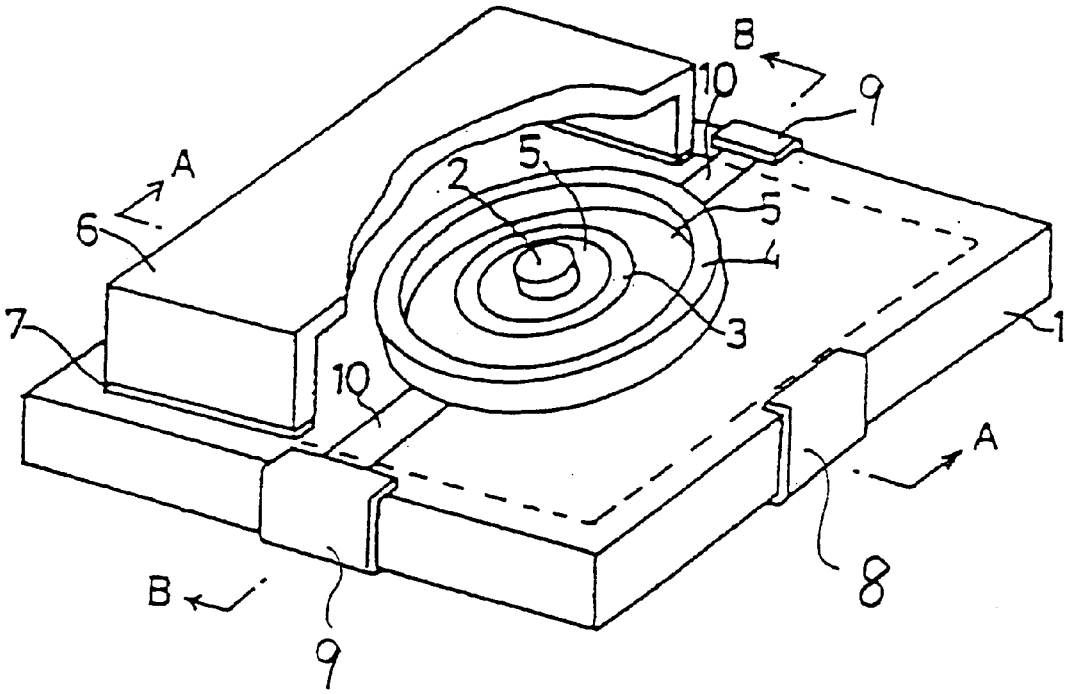
FIG. 7 is a perspective view showing the third aspect of a surge absorber according to the present invention and showing the inner structure by cutting a cap.
Figure 8:
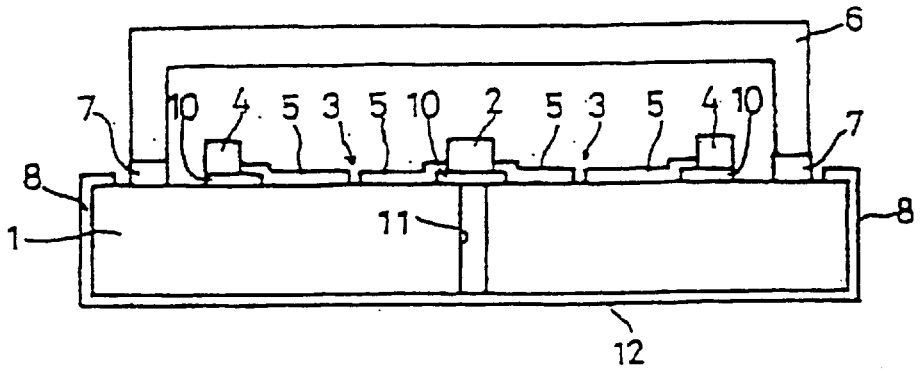
FIG. 8 is a sectional view taken along a line A—A of FIG. 7.
Figure 9:
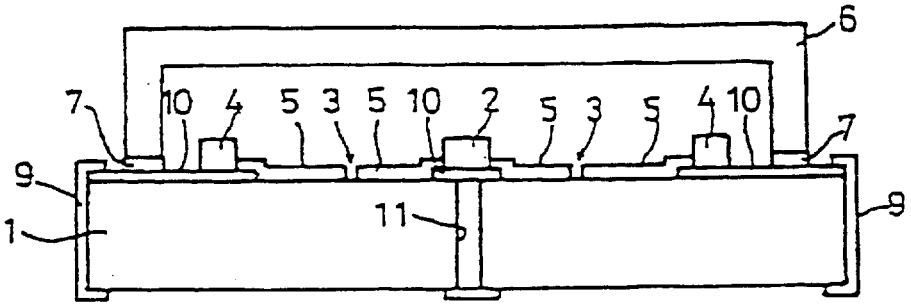
FIG. 9 is a sectional view taken along a line B—B of FIG. 7.

FIG. 7 through FIG. 9 show the embodiment of the third aspect according to the present invention.

FIG. 7 is a perspective view showing the inner structure by partially cutting a cap, FIG. 8 is a sectional view taken along a line A—A of FIG. 7 and FIG. 9 is a sectional view taken along a line B—B thereof.

The alumina substrate 1 which is an insulating substrate provided with the through hole 11 by a publicly-known conventional technology, is prepared, a conductor is filled in the through hole 11 of the alumina substrate 1, the conductive film 10 is formed on the surface of the alumina substrate 1, the conductive film 12 is formed on the rear face, the first terminals 8 are formed respectively on two side faces of the alumina substrate 1 which are remote from each other and the second terminals 9 are formed respectively on two other side faces, TiN is adhered onto the surface of the alumina substrate 1 as the conductive film 5 by sputtering, successively, the micro-gap 3 in a circular shape having the width of about 50 $\mu$m is formed and the conductive film 5 is formed in a desired circular shape by photoetching and the first electrode 2 and the second electrode 4 are attached concentrically with the micro-gap 3.

Further, by welding the cap 6 made of alumina ceramics by the frit glass 7, the micro-gap 3 and the first electrode 2 as well as the second electrode 4 are sealed in Ar gas.

In this case, the first terminals 8 and the second terminals 9 are arranged on the respective side faces of the alumina substrate 1 such that a straight line connecting the first terminals and a straight line connecting the second terminals 9 are orthogonal to each other. The first electrode 2 and the two first terminals 8 are connected to each other via the through hole 11 installed to the substrate 1 and the conductor 12 on the rear face of the substrate 1 and the second electrode 4 and the two terminals 9 are connected to each other by the conductive film formed on the surface of the substrate.

Also according to this embodiment, similar to that in FIG. 4, an embodiment using a via hole can be constituted.

Figure 10:
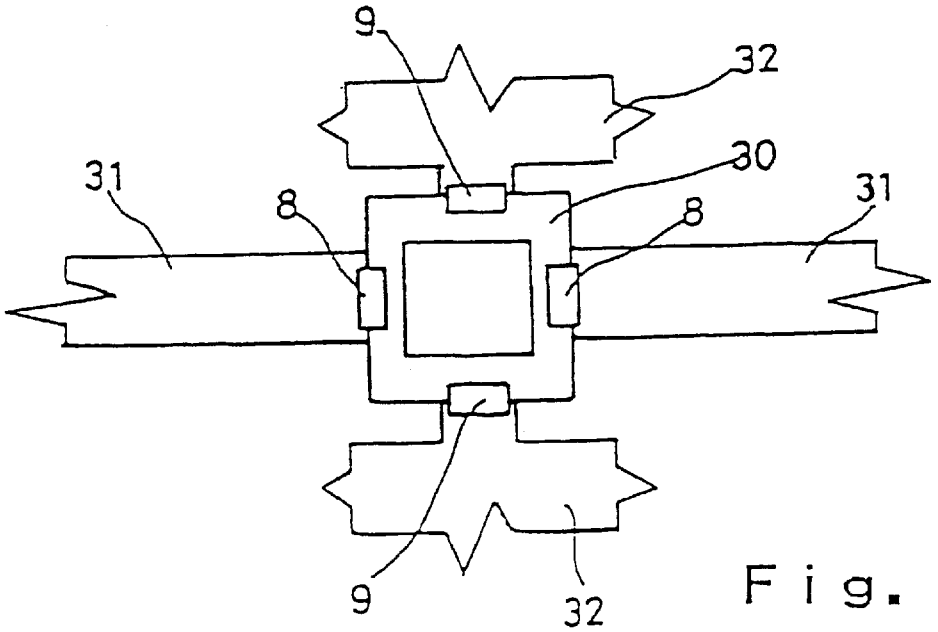
FIG. 10 shows the third aspect of the surge absorber according to the present invention and a wiring diagram of a circuit in which the surge absorber is mounted.

FIG. 10 is a diagram showing a wiring pattern on a circuit board to which the surge absorber according to the third aspect is mounted.

Signal lines 31 and grounding lines 32 on the circuit board are interrupted at positions of wirings of a surge absorber 30 and the signal lines 31 are connected by way of intermediaries of the two terminals 8 of the surge absorber 30. Further, the grounding lines 32 are connected by way of intermediaries of the other two terminals 9 of the surge absorber 30.

In this way, by using the surge absorber according to the present invention, the density of wirings on the substrate can be increased and the density of mounting the surge absorber can be increased. Accordingly, the circuit can be downsized.

Figure 11:
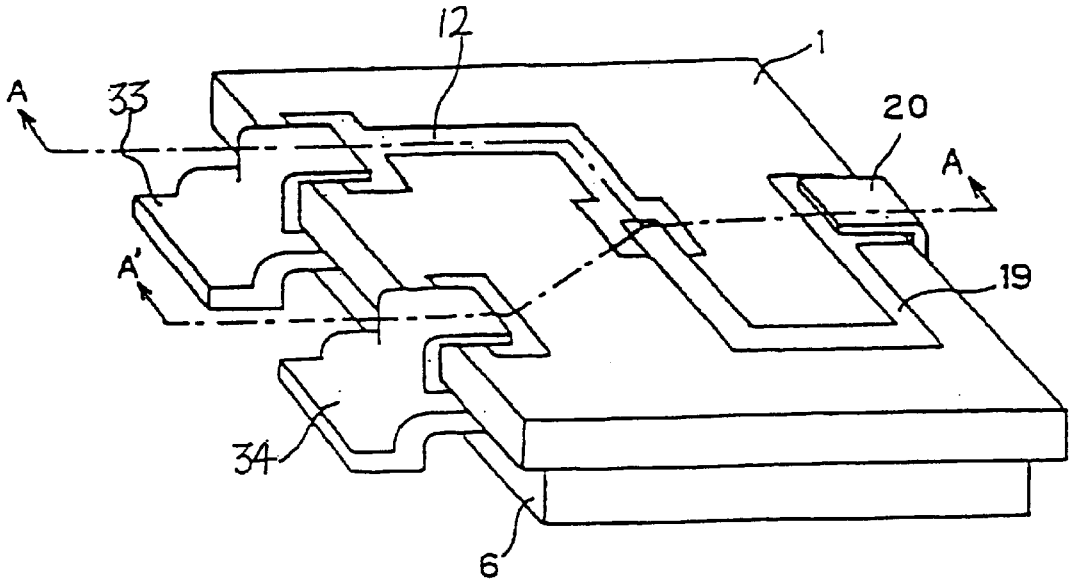
FIG. 11 is a perspective view showing the fourth aspect of a surge absorber according to the present invention.
Figure 12:
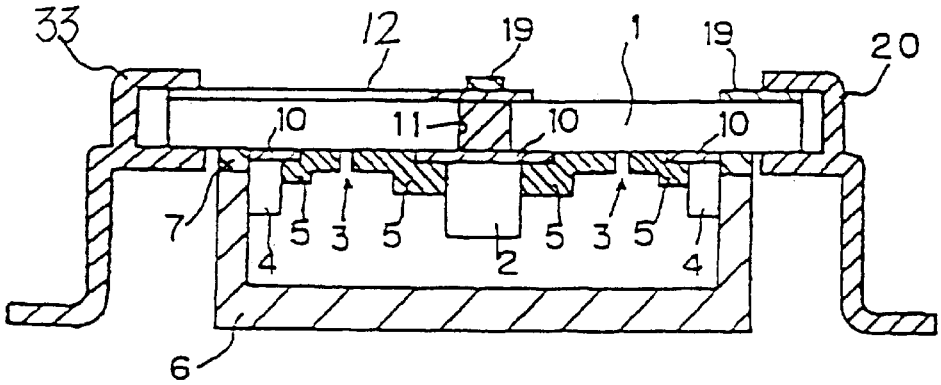
FIG. 12 is a sectional taken along a line A—A of FIG. 11.
Figure 13:
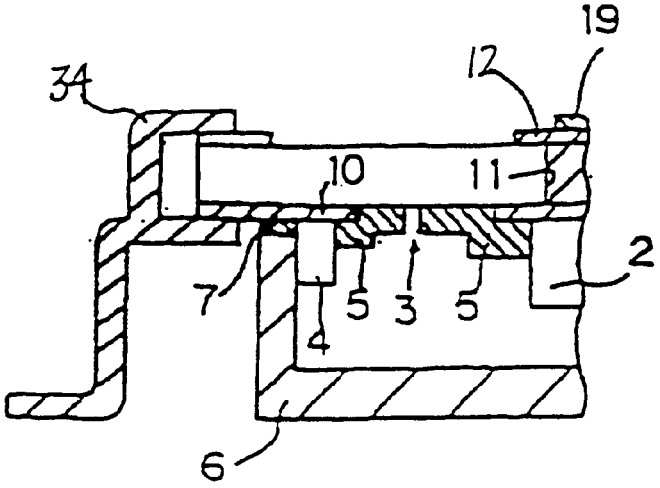
FIG. 13 is a sectional view taken along a line A—A' of FIG. 11.

FIG. 11 through FIG. 13 show the embodiment of the fourth aspect of the present invention.

FIG. 11 is a perspective view in the case where the cap 6 is directed downwardly, FIG. 12 is a sectional view taken along a line A—A of FIG. 11 and FIG. 13 is a sectional view taken from a line A—A' of FIG. 11.

The through hole 11 is formed in the alumina substrate 1 in a flat plate shape which is an insulating substrate by a publicly-known conventional technology, a conductor is filled in the through hole 11, the conductive film 10 is formed on the surface of the alumina substrate 1 and the conductive film 12 and a fuse 19 are formed on the rear face. The fuse 19 is formed by adhering a Pb alloy film by a vapor deposition process. Further, TiN is adhered onto the surface of the alumina substrate 1 as the conductive film 5 by sputtering, successively, the micro-gap 3 in a circular shape having the width of about 50 $\mu$m is formed and the conductive film 5 is formed in a desired circular shape by photoetching and the first electrode 2 and the second electrode 4 are attached to be brought into contact with the conductive film 5 concentrically with the micro-gap 3. Further, by welding the cap 6 made of alumina ceramics by the frit glass 7, the micro-gap 3, the first electrode 2 and the second electrode 4 are sealed in Ar gas and further, leads 33, 34 and 20 having shapes as shown by FIG. 11 and FIG. 12 are attached. According to the embodiment, the leads 33 and 34 correspond respectively to the first terminal and the second terminal and in this embodiment, the third terminal 20 connected to the first electrode 2 via the fuse 19 is installed.

Figure 14:
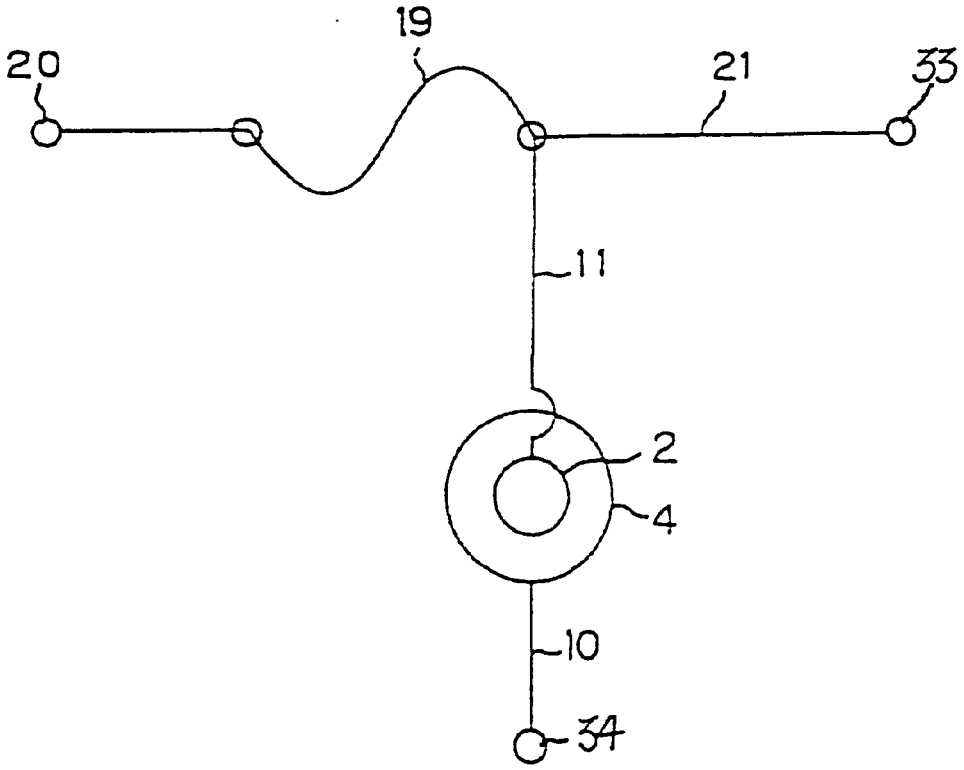
FIG. 14 is an equivalent circuit diagram of the fourth aspect of the surge absorber according to the present invention.

Thereby, there is available a surge absorber having an equivalent circuit in which the fuse 19 is arranged as shown by FIG. 14.

According to the embodiment, there is available the surge absorber integrated with the fuse having high reliability, having small mounting area at low cost.

Also according to the embodiment, the surge absorber provided with a via hole corresponding to that in the embodiment of the first aspect shown by FIG. 4 can be constituted.

Figure 15:
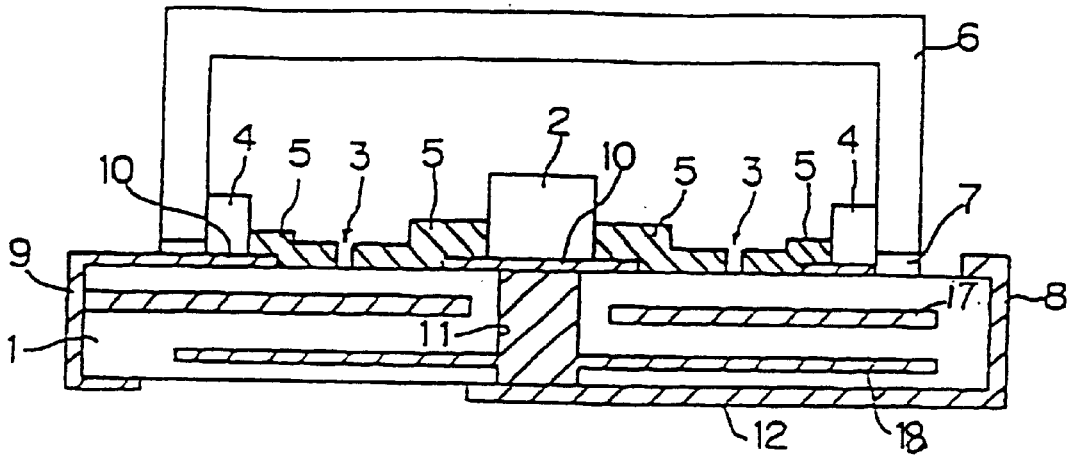
FIG. 15 is a sectional view showing the fifth aspect of a surge absorber according to the present invention.

FIG. 15 shows the embodiment of the fifth aspect according to the present invention.

In this embodiment, the multiple layer substrate 1 in which conductive films 17 and 18 and the through hole 11 are fabricated by a publicly-known conventional technology, is used as an insulating substrate, the conductive films 10 and 12 are formed on the surface and the rear face of the substrate 1 respectively, the first electrode 8 and the second electrode 9 are respectively formed on side faces of the substrate 1, TiN is adhered onto the surface of the substrate 1 as the conductive film 5 by sputtering, successively, the circular micro-gap having the width of about 50 $\mu$m is formed and the conductive film 5 is formed in a desired circular shape by photoetching and the first electrode 2 and the second electrode 4 are attached to be brought into contact with the conductive film 5 concentrically with the micro-gap 3.

Further, the cap 6 made of alumina ceramics is welded by the frit glass 7 by which the micro-gap 3 is sealed in Ar gas.

The first electrode 2 and the conductive film 18 at inside of the substrate are connected to the first terminal 8 via the through hole 11 installed in the substrate 1.

Further, the conductive film 17 formed at inside of the substrate 1 is perforated with a hole at a portion through which the through hole 11 penetrates and is connected to the second terminal 9 by being exposed to an end face of the substrate on the side of the second terminal 9 and is connected to the second electrode 4 by way of the second terminal 9 and the conductive film 10.

Thereby, there is available a surge absorber, the outside shape of which is formed in a flat plate shape, which is suitable for surface mounting which is provided with high reliability in respect of repeated discharge and furthermore which is provided with a condenser for absorbing a high frequency noise.

Figure 16:
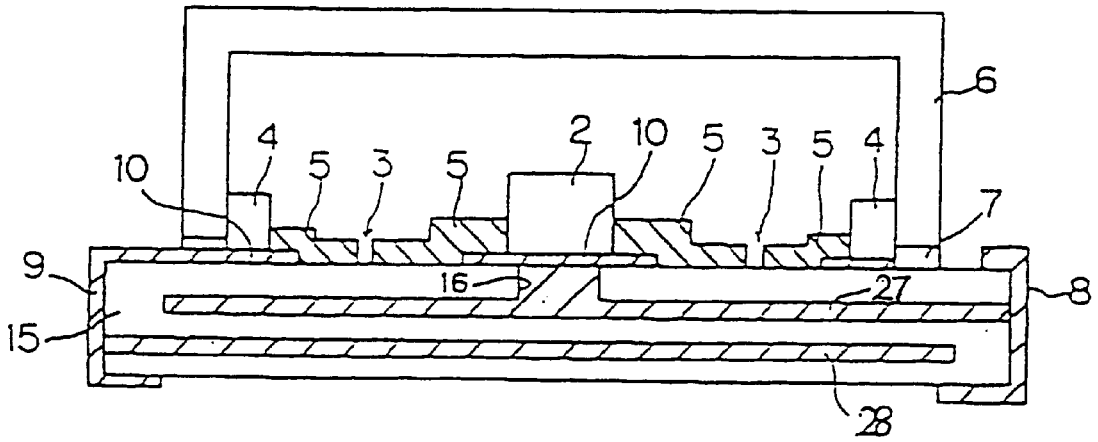
FIG. 16 is a sectional view showing another embodiment of the fifth aspect of the surge absorber according to the present invention.
Figure 17:
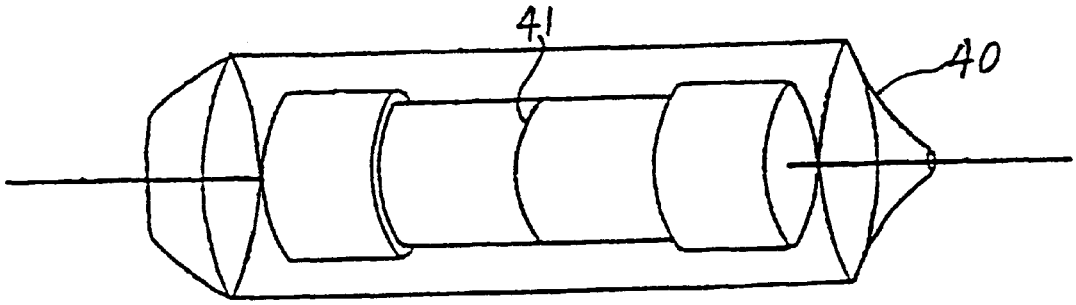
Fig. 17 PRIOR ART
FIG. 17 is a perspective view showing a conventional surge absorber of a cylindrical type.
Figure 18:
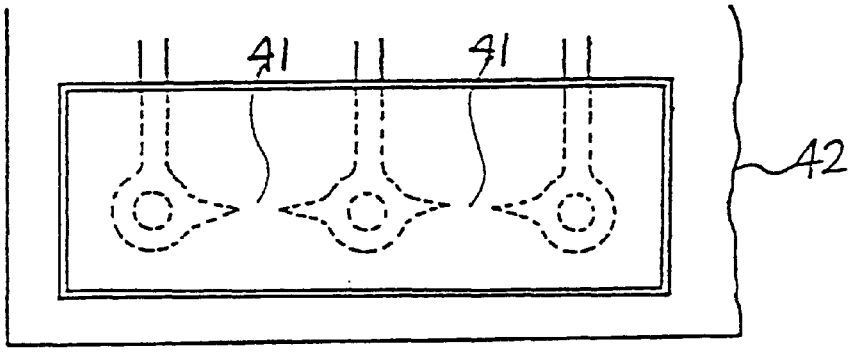
Fig. 18 PRIOR ART
FIG. 18 is a perspective view showing a conventional surge absorber of a flat plate type.

Further, the fifth aspect of the present invention can be provided with an embodiment shown by FIG. 16.

According to this embodiment, there is available a surge absorber in which a conductive film 27 at inside of an insulating substrate is electrically connected to a via hole 16, another conductive film 28 is electrically connected to the second terminal 9 and a condenser is formed by both of the conductive films.

What is claimed is:

1. A surge absorber comprising:

an insulating substrate in a flat plate shape;

a conductive film having a gap in an annular shape and formed in a circular disk shape concentric with the gap on the insulating substrate;

a first electrode arranged at a central portion of the conductive film;

a second electrode in an annular shape constituting a circle concentric with the gap arranged at a peripheral edge portion of the conductive film;

an air-tight crowned member for hermetically sealing the conductive film, the first electrode and the second electrode in a state where a predetermined gas is filled at an inside thereof in cooperation with the insulating substrate;

at least one first terminal arranged at an outside of the air-tight crowned member for being electrically connected to the first electrode; and at least one second terminal arranged at the outside of the air-tight crowned member for being electrically connected to the second electrode.

2. The surge absorber according to claim 1, wherein the first electrode and the at least one first terminal is electrically connected by a through hole formed at a portion of the insulating substrate where the first electrode is arranged, penetrated between a surface and a rear face of the insulating substrate and filled with a conductor electrically connected to the first electrode at an inside thereof and a conductive film formed on the rear face of the insulating substrate for electrically connecting the conductor in the through hole with the at least one first terminal.

3. The surge absorber according to claim 2, wherein the second electrode constitutes a portion of the air-tight crowned member.

4. The surge absorber according to claim 2, wherein the second electrode serves as the air-tight crowned member.

5. The surge absorber according to claim 2, wherein the at least one first terminal comprises two first terminals respectively formed at two side faces of the insulating substrate remote from each other and the at least one second terminal comprises two second terminals respectively formed on two side faces of the insulating substrate where the two first terminals are not formed.

6. The surge absorber according to claim 1, wherein the first electrode and the at least one first terminal is electrically connected by a hole formed at a portion of the insulating substrate where the first electrode is arranged and where the hole is filled with a conductor electrically connected to the first electrode at an inside thereof and a conductive layer formed at an inside of the insulating substrate, electrically connected to the at least one first terminal and electrically connected to the conductor at the inside of the hole at a bottom portion of the hole.

7. The surge absorber according to claim 6, wherein the second electrode constitutes a portion of the air-tight crowned member.

8. The surge absorber according to claim 6, wherein the second electrode serves as the air-tight crowned member.

9. The surge absorber according to claim 6, wherein the at least one first terminal comprises two first terminals respectively formed at two side faces of the insulating substrate remote from each other and the at least one second terminal comprises two second terminals respectively formed on two side faces of the insulating substrate where the two first terminals are not formed.

10. The surge absorber according to claim 1, further comprising an insulating film formed on the insulating substrate, the conductive film, the first electrode and the second electrode being formed or arranged on the insulating film, wherein the first electrode and the at least one first terminal are electrically connected by a hole formed at a position of the insulating film where the first electrode is arranged and where the hole is filled with a conductor electrically connected to the first electrode at an inside thereof and a conductive film formed between the insulating substrate and the insulating film for electrically connecting the conductor at the inside of the hole with the at least one first terminal.

11. The surge absorber according to claim 10, wherein the second electrode constitutes a portion of the air-tight crowned member.

12. The surge absorber according to claim 10, wherein the at least one first terminal comprises two first terminals respectively formed at two side faces of the insulating substrate remote from each other and the at least one second terminal comprises two second terminals respectively formed on two side faces of the insulating substrate where the two first terminals are not formed.

13. The surge absorber according to claim 10, wherein the second electrode serves as the air-tight crowned member.

14. The surge absorber according to claim 1 wherein the second electrode constitutes a portion of the air-tight crowned member.

15. The surge absorber according to claim 1 wherein the second electrode serves as the air-tight crowned member.

16. The surge absorber according to claim 1, wherein the at least one first terminal comprises two first terminals respectively formed at two side faces of the insulating substrate remote from each other and the at least one second terminal comprises two second terminals respectively formed on two side faces of the insulating substrate where the two first terminals are not formed.

17. The surge absorber according to claim 1, further comprising:

a third terminal arranged at an outside of the air-tight crowned member constituted by being connected to either one terminal of the at least one first terminal and the at least one second terminal via an electrically connecting path in a film-like shape formed on a rear face of the insulating substrate and composed of a fuse in a film-like shape at least at one portion thereof.

18. The surge absorber according to claim 17, wherein the first electrode and the at least one first terminal is electrically connected by a through hole formed at a portion of the insulating substrate where the first electrode is arranged, penetrated between a surface and a rear face of the insulating substrate and where the through hole is filled with a conductor electrically connected to the first electrode at an inside thereof and a conductive film formed on the rear face of the insulating substrate for electrically connecting the conductor in the through hole with the at least one first terminal; and wherein the conductive film and the third terminal are electrically connected by the fuse formed in the film-like shape on the rear face of the insulating substrate.

19. The surge absorber according to claim 18, wherein the first electrode and the at least one first terminal are electrically connected by a hole formed at a portion of the insulating substrate where the first electrode is arranged and where the hole is filled with a conductor electrically connected to the first electrode at an inside thereof and a conductive layer formed at an inside of the insulating substrate, electrically connected to the at least one first terminal and electrically connected to the conductor at the inside of the hole at a bottom portion of the hole and either one terminal of the at least one first terminal and the at least one second terminal is electrically connected to the third terminal by the fuse formed in the film-like shape on the rear face of the insulating substrate.

20. The surge absorber according to claim 1, further comprising a condenser comprising a plurality of sheets of conductive films, at least one sheet of which extends at the inside of the insulating substrate and which extend in parallel with each other, said condenser being formed between the at least one first terminal and the at least one second terminal.

* * * * *